US008737852B2

(12) United States Patent
Aoshima et al.

(10) Patent No.: US 8,737,852 B2
(45) Date of Patent: May 27, 2014

(54) IMAGE FORMING APPARATUS, IMAGE FORMING SYSTEM, AND COMPUTER READABLE MEDIUM

(75) Inventors: Taku Aoshima, Kanagawa (JP); Tadashi Kiyama, Kanagawa (JP); Toshie Nakamoto, Kanagawa (JP); Hiroaki Akamatsu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 223 days.

(21) Appl. No.: 13/475,517

(22) Filed: May 18, 2012

(65) Prior Publication Data

US 2013/0164003 A1 Jun. 27, 2013

(30) Foreign Application Priority Data

Dec. 27, 2011 (JP) ..... 2011-284822

(51) Int. Cl.
*G03G 21/12* (2006.01)

(52) U.S. Cl.
CPC ..... *G03G 21/12* (2013.01)
USPC ..... 399/35

(58) Field of Classification Search
CPC ..... G03G 21/12
USPC ..... 399/35, 360
See application file for complete search history.

(56) References Cited

U.S. PATENT DOCUMENTS

| | | | | |
|---|---|---|---|---|
| 4,730,205 | A * | 3/1988 | Ogiri et al. | 399/35 |
| 5,890,049 | A * | 3/1999 | Williams et al. | 399/360 |
| 6,298,217 | B1 * | 10/2001 | Murayama et al. | 399/360 X |
| 7,373,092 | B2 * | 5/2008 | Tawada | 399/35 |
| 2008/0181633 | A1 * | 7/2008 | Oh | 399/35 |
| 2009/0263147 | A1 | 10/2009 | Kumagai | |
| 2010/0166441 | A1 * | 7/2010 | Kobayashi | 399/35 |

FOREIGN PATENT DOCUMENTS

| | | |
|---|---|---|
| JP | A-9-237020 | 9/1997 |
| JP | A-2009-265161 | 11/2009 |

* cited by examiner

*Primary Examiner* — Sandra Brase
(74) *Attorney, Agent, or Firm* — Oliff PLC

(57) ABSTRACT

An image forming apparatus includes a body, a developer recovery container, a detecting section, a power supply, a detection object part, a pair of wires, a conducting section, a drive section, and a determining section. The determining section determines the developer recovery container to have been used in a case where the developer is determined to be not present in the detection object part on the basis of information from the detecting section, and in a case where the developer is determined to be present in the detection object part, checks the information from the detecting section again after driving the drive section, and determines the recovery container to have not been used when the developer is determined to be not present in the detection object part and determines the recovery container to have been used when the developer is determined to be present in the detection object part.

6 Claims, 7 Drawing Sheets

FIG. 9

| | RECOVERY BOX UNATTACHED | RECOVERY BOX ATTACHED | | |
|---|---|---|---|---|
| UNUSED/USED | – | UNUSED | USED | USED |
| RECOVERY STATUS | – | VACANT | NEAR FULL | VACANT |
| PRESENCE DETECTION | NO | YES | YES | YES |
| RECOVERY STATUS JUDGMENT A | NEAR FULL (LIGHT OFF) | NEAR FULL (LIGHT OFF) | NEAR FULL (LIGHT BLOCKED) | VACANT (LIGHT RECEIVED) |
| INITIAL DRIVE | – | YES | YES | NO |
| | | ↓ | ↓ | |
| AFTER INITIAL DRIVE | | ↓ | ↓ | |
| RECOVERY STATUS JUDGMENT B | – | VACANT | NEAR FULL | – |
| DETERMINATION | UNATTACHED | UNUSED | USED | USED |
| HISTORY | – | CLEAR | RETAIN | RETAIN |

IMAGE FORMING APPARATUS, IMAGE FORMING SYSTEM, AND COMPUTER READABLE MEDIUM

CROSS-REFERENCE TO RELATED APPLICATIONS

This application is based on and claims priority under 35 USC 119 from Japanese Patent Application No. 2011-284822 filed Dec. 27, 2011.

BACKGROUND

Technical Field

The present invention relates to an image forming apparatus, an image forming system, and a computer readable medium.

SUMMARY

According to an aspect of the invention, there is provided an image forming apparatus including a body, a developer recovery container that is detachably provided to the body, and contains a developer that has been recovered, a detecting section that is provided to the body, and detects a recovery status of the developer contained within the developer recovery container, a power supply that supplies electric power to the detecting section, a detection object part that is provided to the developer recovery container, and is a part to be detected by the detecting section, the detection object part indicating the recovery status of the developer in the developer recovery container on a basis of presence or absence of the developer, a pair of wires that are provided to the developer recovery container, the wires being electrically isolated from each other and one of the wires being electrically connected to the detecting section and the other of the wires being electrically connected to the power supply in a case where the developer recovery container has not been used, a conducting section that is provided to the developer recovery container, and is located in a first position in a case where the developer recovery container has not been used and is located in a second position in a case where the developer recovery container has been used, the first position being a position that brings the pair of wires into a non-conducting state, the second position being a position that brings the pair of wires into a conducting state, a drive section that electrically connects the pair of wires and drives the conducting section to the second position to maintain the conducting state of the pair of wires, and a determining section that determines the developer recovery container to have been used in a case where the developer is determined to be not present in the detection object part on a basis of information from the detecting section, and in a case where the developer is determined to be present in the detection object part, checks the information from the detecting section again after driving the drive section, and determines the developer recovery container to have not been used in a case where the developer is determined to be not present in the detection object part and determines the developer recovery container to have been used in a case where the developer is determined to be present in the detection object part.

BRIEF DESCRIPTION OF THE DRAWINGS

Exemplary embodiment of the present invention will be described in detail based on the following figures, wherein:

FIG. 9 illustrates a summary of the results of the processing in FIG. 8.

DETAILED DESCRIPTION

Hereinafter, an exemplary embodiment of the present invention is described in detail with reference to the figures. In the figures for explaining the exemplary embodiment, the same constituent elements are basically denoted by the same symbols, and a description of those constituent elements is not repeated.

Figure 1:
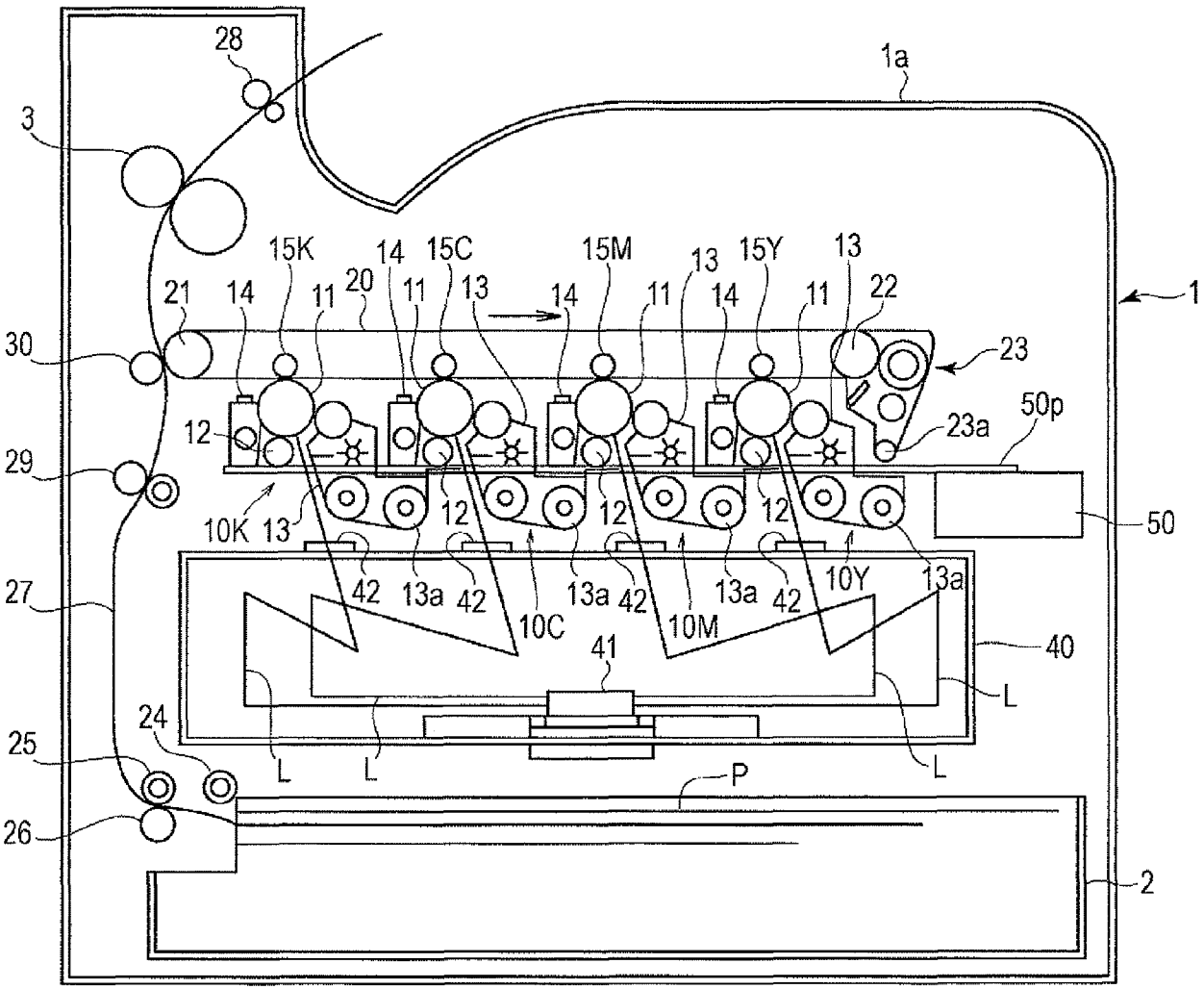
FIG. 1 illustrates an example of an image forming apparatus according to an exemplary embodiment of the invention.
Figure 2:
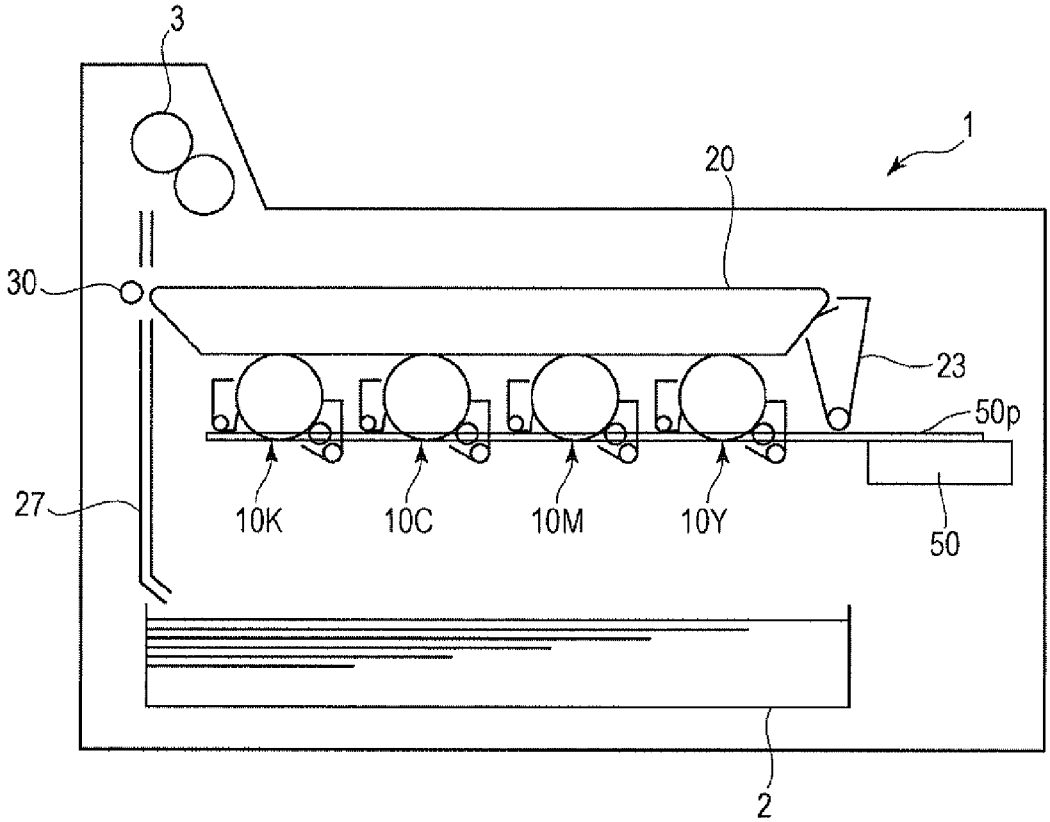
FIG. 2 illustrates an example of the arrangement position of a developer recovery container that has been attached to the image forming apparatus illustrated in FIG. 1.

FIG. 1 illustrates an example of an image forming apparatus according to an exemplary embodiment of the invention. FIG. 2 illustrates an example of the arrangement position of a developer recovery container in the image forming apparatus illustrated in FIG. 1.

As illustrated in FIG. 1, a tandem color laser beam printer (hereinafter, simply referred to as printer, which is an example of the image forming apparatus) 1 having a recovery box for waste toner (an example of used developer) attached to the printer 1 includes four image forming engines 10Y, 10M, 10C, and 10K that form toner images of the colors yellow, magenta, cyan, and black, respectively. The printer 1 also includes an intermediate transfer belt 20. The toner images from these image forming engines are transferred to the intermediate transfer belt 20 in a superposed manner (first transfer). A superposed toner image transferred onto the intermediate transfer belt 20 is further transferred to a recording medium such as a recording sheet P (second transfer), forming a full-color image.

The intermediate transfer belt 20 is formed as an endless belt, and is wound around a pair of belt transport rollers 21 and 22. As the intermediate transfer belt 20 rotates in the direction indicated by an arrow in FIG. 1, the intermediate transfer belt 20 receives the first transfer of the toner images of respective colors formed by the image forming engines 10Y, 10M, 10C, and 10K.

A second transfer roller 30 is provided at a position where the second transfer roller 30 faces the belt transport roller 21 across the intermediate transfer belt 20. As the recording sheet P is passed between the second transfer roller 30 and the intermediate transfer belt 20 that are in contact in such a way as to press against each other, the recording sheet P receives the second transfer of the toner image from the intermediate transfer belt 20. A belt cleaner 23 for the intermediate transfer belt 20 is arranged at a position where the belt cleaner 23 faces the other belt transport roller 22 located opposite to the belt transport roller 21. The belt cleaner 23 removes toner that remains adhering to the intermediate transfer belt 20 after the second transfer, from the intermediate transfer belt 20. The residual toner removed by the belt cleaner 23 is transported as waste toner to the front side (the near side in FIG. 1) by a transport shaft 23*a* having a spiral blade and is recovered into a waste-toner recovery box described later. Waste toner refers to toner that is removed from a photoconductor drum or the intermediate transfer belt 20 for disposal.

The four image forming engines 10Y, 10M, 10C, and 10K mentioned above are arranged in a parallel fashion under the intermediate transfer belt 20. Toner images formed in accordance with image information of the corresponding colors are transferred to the intermediate transfer belt 20 by first transfer. The four image forming engines 10Y, 10M, 10C, and 10K are arranged in order of yellow, magenta, cyan, and black along the direction of rotation of the intermediate transfer belt 20. The image forming engine 10K for black generally the most frequently used among these image forming engines is arranged closest to the second transfer position.

A raster scanning unit 40 is provided below the image forming engines 10Y, 10M, 10C, and 10K. The raster scanning unit 40 exposes a photoconductor drum 11 equipped to each of the image forming engines in accordance with image information. All the image forming engines 10Y, 10M, 10C, and 10K share the raster scanning unit 40. The raster scanning unit 40 includes four semiconductor lasers (not shown), and a single polygonal mirror 41. The four semiconductor lasers emit four laser beams L that are modulated in accordance with the image information of the corresponding colors. The polygonal mirror 41 rotates at high speed to axially scan the corresponding photoconductor drum 11 with a laser beam L. The laser beam L directed to scan the corresponding photoconductor drum 11 by the polygonal mirror 41 propagates along a predetermined path while being reflected by mirrors (not shown), before exposing the photoconductor drum 11 of the corresponding one of the image forming engines 10Y, 10M, 10C, and 10K through a scanning window 42 provided at the top of the raster scanning unit 40.

Each of the image forming engines 10Y, 10M, 10C, and 10K includes the photoconductor drum 11, a charging roller 12, a developing unit 13, and a drum cleaner 14. The charging roller 12 charges the surface of the photoconductor drum 11 to a specified potential. The developing unit 13 develops an electrostatic latent image that is formed on the photoconductor drum 11 by exposure to the laser beam L, thereby forming a toner image. The drum cleaner 14 removes residual toner and paper dust from the surface of the photoconductor drum 11 after the toner image is transferred to the intermediate transfer belt 20. Each of the image forming engines 10Y, 10M, 10C, and 10K forms a toner image on the photoconductor drum 11 in accordance with image information of the corresponding color.

The developing unit 13 used in the printer 1 according to the exemplary embodiment is of a type that uses a two-component developer that is a mixture of toner and carrier. A trickle development system is employed in the developing unit 13 to obviate maintenance i.e., replacement of developer that has deteriorated with time. In the trickle development system, a developer in the form of a mixture of toner and carrier is supplied from a supply cartridge (not illustrated), and the developer that has deteriorated is automatically discharged.

Each of the developing units 13 is replenished with new developer supplied from the rear side (the far side in FIG. 1) of a transport shaft 13*a* having a spiral blade like the transport shaft 23*a* mentioned above. Residual toner removed by each of the drum cleaners 14 is discharged as waste toner to the front side by a transport shaft (not illustrated). Then, the waste toner discharged from the drum cleaner 14 is recovered into a waste-toner recovery box described later.

In the exemplary embodiment, as an example of developer to be recovered, the waste-toner recovery box recovers waste toner including used toner discharged from the drum cleaner 14 and used toner discharged from the belt cleaner 23. A recovery box according to an exemplary embodiment may recover, for example, carrier and toner discharged from the developing unit 13 or only used toner discharged from the drum cleaner 14.

First transfer rollers 15Y, 15M, 15C, and 15K are provided at positions where the first transfer rollers 15Y, 15M, 15C, and 15K face the photoconductor drums 11 of the image forming engines 10Y, 10M, 10C, and 10K, respectively, across the intermediate transfer belt 20. By applying a transfer bias voltage to each of the transfer rollers 15Y, 15M, 15C, and 15K, an electric field is formed between the photoconductor drum 11 and the corresponding one of the transfer rollers 15Y, 15M, 15C, and 15K. Thus, the charged toner image on the photoconductor drum 11 is transferred to the intermediate transfer belt 20 by the Coulomb force.

The recording sheet P is transported from a paper feed cassette 2 contained in a lower portion of the printer 1 to the inside of the housing, more specifically, the second transfer position at which the intermediate transfer belt 20 contacts the second transfer roller 30. To set the paper feed cassette 2 in place, the paper feed cassette 2 is pushed in from the front side of the printer 1. A pickup roller 24 and a feed roller 25 are provided above the paper feed cassette 2 that has been set in place. The pickup roller 24 picks up the recording sheet P accommodated in the paper feed cassette 2. Also, a retard roller 26 is provided at a position where the retard roller 26 faces the feed roller 25. The retard roller 26 prevents double feeding of recording sheets P.

A transport path 27 for the recording sheet P in the printer 1 is provided vertically along the left side face of the printer 1. The recording sheet P picked from the paper feed cassette 2 located at the bottom of the printer 1 moves upwards along the transport path 27, and is then introduced to the second transfer position, with its entry timing controlled by a registration roller 29. After receiving transfer of the toner image at the second transfer position, the recording sheet P is sent to a fixing unit 3 provided in an upper portion of the printer 1. The fixing unit 3 fixes the toner image to the recording sheet P. The recording sheet P is then ejected by an eject roller 28 to a paper output tray 1*a* provided on the top face of the printer 1, in a state in which the side of the recording sheet P with the image formed faces down.

To form a full-color image with the printer 1 configured as mentioned above, the raster scanning unit 40 exposes the respective photoconductor drums 11 of the image forming engines 10Y, 10M, 10C, and 10K at predetermined timing in accordance with the image information of the corresponding colors. Accordingly, electrostatic latent images corresponding to the image information are formed on the respective photoconductor drums 11 of the image forming engines 10Y, 10M, 10C, and 10K. A toner image is formed by supplying toner to each of these electrostatic latent images.

The toner images formed on the respective photoconductor drums 11 of the image forming engines 10Y, 10M, 10C, and 10K are successively transferred to the rotating intermediate transfer belt 20. Thus, a multiple-color toner image with the toner images of various colors superposed on one another is formed on the intermediate transfer belt 20. The recording sheet P is sent out from the paper feed cassette 2, and passed between the second transfer roller 30 and the intermediate transfer belt 20 in synchronization with the timing when the toner image transferred onto the intermediate transfer belt 20 by first transfer reaches the second transfer position. Accordingly, the multiple-color toner image on the intermediate transfer belt 20 is transferred to the recording sheet P by second transfer. Then, the toner image transferred to the recording sheet P by second transfer is fixed to the recording sheet P by the fixing unit 3, thus completing formation of a full-color image on the recording sheet P.

In the printer 1 according to the exemplary embodiment configured as mentioned above, waste toners discharged from the belt cleaner 23 and each of the drum cleaners 14 are all recovered into a single common waste-toner recovery box 50 (an example of a developer recovery container).

Referring to FIGS. 1 and 2, the waste-toner recovery box 50 is provided at an end (right end in FIGS. 1 and 2) inside the printer 1. A waste-toner discharge part at one end of a recovery pipe 50*p* for waste toner is inserted into the recovery port of the waste-toner recovery box 50. The recovery pipe 50*p* is provided below the respective drum cleaners 14 of the image forming engines 10Y, 10M, 10C, and 10K, and the belt cleaner 23 of the intermediate transfer belt 20. The recovery pipe 50*p* extends from the waste-toner recovery box 50 located upstream in the transport direction to a position under the image forming engine 10K located most downstream in the transport direction. Waste toner discharged from each of the drum cleaners 14 is recovered into the waste-toner recovery box 50 via the recovery pipe 50*p* for waste toner. Waste toner removed from the intermediate transfer belt 20 by the belt cleaner 23 is also recovered into the waste-toner recovery box 50 via the recovery pipe 50*p* for waste toner.

Figure 3:
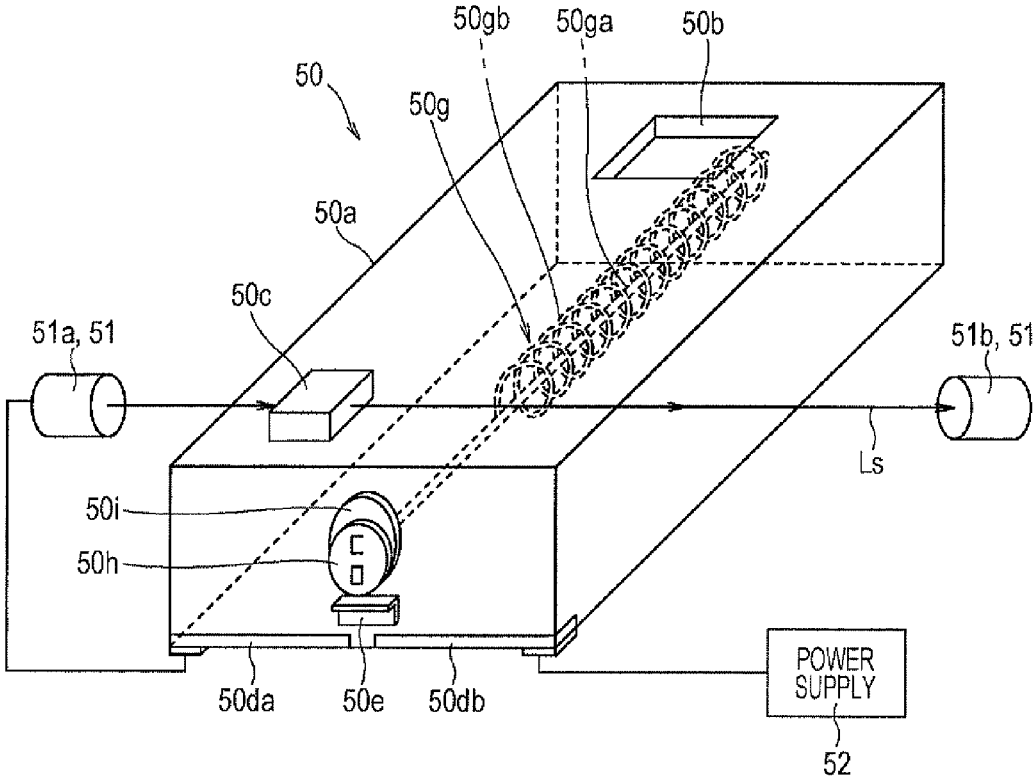
FIG. 3 is a perspective view of an unused developer recovery container that is attachable to the image forming apparatus illustrated in FIG. 1.
Figure 4:
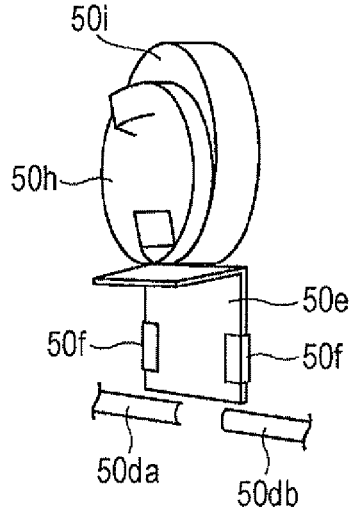
FIG. 4 is an enlarged perspective view of a connecting part of a pair of wires for the developer recovery container illustrated in FIG. 3.
Figure 5:
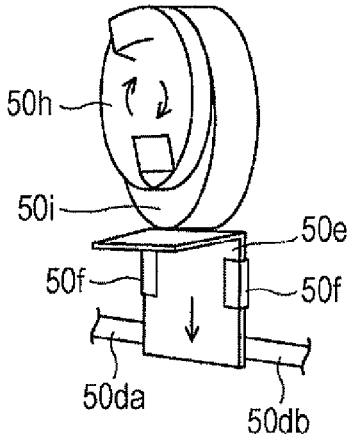
FIG. 5 is an enlarged perspective view of the connecting part of the pair of wires for the developer recovery container illustrated in FIG. 3.
Figure 6:
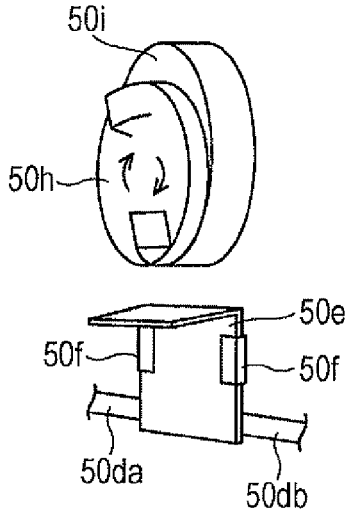
FIG. 6 is an enlarged perspective view of the connecting part of the pair of wires for the developer recovery container illustrated in FIG. 3.

Next, FIG. 3 is a perspective view of the waste-toner recovery box 50 that is unused. FIGS. 4 to 6 are enlarged perspective views of a connecting part of a pair of wires for the waste-toner recover box 50 illustrated in FIG. 3.

As illustrated in FIG. 3, the waste-toner recover box 50 is formed by, for example, a housing 50*a* having a rectangular parallelepiped shape and made of plastic. A recovery space for waste toner is defined inside the housing 50*a*.

A recovery port 50*b* for waste toner is provided at one longitudinal end side (at the center in the widthwise direction) on the top face of the housing 50*a*. The recovery port 50*b* is a recovery port for the waste toners discharged from the respective drum cleaners 14 of the image forming engines 10Y, 10M, 10C, and 10K and the belt cleaner 23. When the waste-toner recovery box 50 is attached to the printer 1, the waste-toner discharge part of the recovery pipe 50*p* (see FIGS. 1 and 2) mentioned above is inserted into the recovery port 50*b* arranged on the front side of the printer 1, and waste toners discharged from the drum cleaners 14 and the belt cleaner 23 are dropped into the waste-toner recovery box 50.

A detection window (an example of a detection object part) 50*c* is provided at the other longitudinal end side (at a position shifted from the center in the widthwise direction) on the top face of the housing 50*a* so as to project from the top face of the housing 50*a*. A detection space is defined inside the detection window 50*c*. This detection space communicates with the recovery space inside the housing 50*a* mentioned above. When the recovery space becomes nearly full of waste toner, part of the waste toner is routed into the detection space. Consequently, when there is waste toner in the detection space, the recovery space is determined to be nearly full of waste toner, that is, in a near-full state (one form of toner recovery status), and when there is no waste toner in the detection space, the recovery space is determined to be in a vacant state (one form of toner recovery status). The "near-full state" refers to such a state that the recovery space is not completely but is nearly full of waste toner, and serves as a trigger for computing the timing when displaying the full state on the display of the printer 1.

The detection window 50*c* is located between a light emitting part 51*a* and a light receiving part 51*b* of a light transmission sensor (an example of a detecting section) 51 provided on the printer 1, when the waste-toner recovery box 50 is attached to the printer 1. In this case, when the area between the light emitting part 51*a* and the light receiving part 51*b* of the light transmission sensor 51 is blocked by waste toner in the detection space inside the detection window 50*c*, the signal of the light transmission sensor 51 changes, thereby detecting the presence or absence of waste toner in the detection space inside the detection window 50*c*. Specifically, if there is waste toner in the detection space inside the detection window 50*c*, light Ls emitted from the light emitting part 51*a* is blocked by the detection window 50*c* and not received by the light receiving part 51*b*, and if there is no waste toner in the detection space inside the detection window 50*c*, the light Ls is transmitted through the detection window 50*c* and received by the light receiving part 51*b*. In this way, the presence or absence of waste toner inside the detection window 50*c* is detected. As a result, it is learned whether or not the recovery space of the housing 50*a* is nearly full of built-up waste toner. At least the portion of the detection window 50*c* through which the light Ls passes is formed by a transparent member.

A pair of wires 50*da* and 50*db* is provided at the bottom side along one longitudinal end face of the housing 50*a* of the waste-toner recovery box 50, in a state in which the wires 50*da* and 50*db* are electrically isolated from each other. When the waste-toner recovery box 50 is attached to the printer 1, the wire 50*da* is electrically connected to the light emitting part 51*a* of the light transmission sensor 51, and the other wire 50*db* is electrically connected to a power supply 52. The power supply 52 supplies a power supply voltage to the light emitting part 51*a* of the light transmission sensor 51.

As illustrated in FIGS. 3 to 6, a conductive member (an example of a conducting section) 50*e* is provided at one longitudinal end face of the housing 50*a*. As illustrated in FIGS. 3 and 4, in a case where the waste-toner recovery box 50 is unused (i.e. has not yet been used), the conductive member 50*e* is located in a first position while being supported in place by a recovery box guide member 50*f*. In the first position, the conductive member 50*e* is located directly above the area between the opposing ends of the pair of wires 50*da* and 50*da*, and the pair of wires 50*da* and 50*db* is in a non-conducting state. In this case, the light emitting part 51*a* is not electrically connected to the power supply 52 and thus does not emit light.

As illustrated in FIGS. 5 and 6, in a case where the waste-toner recovery box 50 is used (i.e. has previously or already been used), the conductive member 50*e* is located in a second position while being supported in place by the recovery box guide member 50*f*. In the second position, the conductive member 50*e* is located between the opposing ends of the pair of wires 50*da* and 50*da*, and the pair of wires 50*da* and 50*db* is in a conducting state. In this case, the light emitting part 51*a* is electrically connected to the power supply 52 via the pair of wires 50*da* and 50*db* and the conductive member 50*e*, and thus emits light. Power is supplied to the light receiving part 51*b* irrespective of whether the waste-toner recovery box 50 is unused or used.

As illustrated in FIG. 3, for example, a spiral leveling member (an example of a leveling section) 50*g* is provided in the recovery space of the housing 50*a*. The leveling member 50*g* is provided along the longitudinal direction of the housing 50*a* so as to be rotatable about a rotary shaft 50*ga*, so that the leveling member 50*g* transports waste toner dropped into the recovery space through the recovery port 50*b* toward the detection window 50*c* located opposite from the recovery port 50*b*, and also levels the waste toner in the recovery space.

The leveling member 50*g* uses, for example, a coil-like auger that is fabricated by machining a metal wire rod, and has a transport part 50*gb* provided around the rotary shaft 50*ga* to transport waste toner. The winding direction of the transport part 50*gb* is determined so that when the rotary shaft 50*ga* is rotated, waste toner is transported from the recovery port 50*b* toward the detection window 50*c*.

The coil-like auger part does not exist at the end side toward which waste toner is transported. This is to avoid an increase in torque necessary for the rotational drive when waste toner accumulates. However, the configuration employed may be other than this as long as it is possible to avoid failure due to an increase in torque and ensure reliable transport and proper detection in the detection window 50*c*.

The transport part 50*gb* for transporting waste toner is not limited to the spiral wire rod according to the exemplary embodiment. For example, the transport part 50*gb* may be in the form of multiple flat blades spaced apart from each other, a resin-molded spiral blade, or the like. That is, blades of various shapes may be employed as long as such blades have the function of transporting waste toner.

One end of the leveling member 50*g* is connected to a coupling part 50*h* outside the housing 50*a*. The coupling part 50*h* is provided at one longitudinal end face of the housing 50*a*, directly above the area between the opposing ends of the pair of wires 50*da* and 50*db*. When the waste-toner recovery box 50 is attached to the printer 1, the coupling part 50*h* is located on the back side of the printer 1. The coupling part 50*h* transmits the driving force from a drive motor (denoted by symbol M in FIG. 7 but not illustrated in FIGS. 3 to 6) provided inside the printer 1 to the leveling member 50*g*. Accordingly, when the waste-toner recovery box 50 is attached to the printer 1, the coupling part 50*h* is mechanically coupled to the drive motor inside the printer 1, and the leveling member 50*g* is driven (rotated) by the drive motor.

As illustrated in FIGS. 3 to 6, the coupling part 50*h* is integrally provided with a cam part 50*i* having the same rotation axis as that of the coupling part 50*h*. The cam part 50*i* rotates in synchronization with rotation of the coupling part 50*h*. The shape of the cam part 50*i* taken along the plane crossing the rotational axis is an oval or elliptical shape with a projecting portion that partially projects from the outer periphery of the coupling part 50*h*.

Operation of the cam part 50*i* is described with reference to FIGS. 4 to 6. FIG. 4 illustrates a case where the waste-toner recovery box 50 is unused. In this case, as mentioned above, the conductive member 50*e* is located in the first position directly above the area between the pair of wires 50*da* and 50*db*, and the pair of wires 50*da* and 50*db* are in a non-conducting state. The projecting portion of the cam part 50*i* is located opposite to the conductive member 50*e*.

As illustrated in FIG. 5, when the coupling part 50*h* is rotated by 180 degrees in this state, the cam part 50*i* also rotates by 180 degrees, and the projecting portion of the cam part 50*i* pushes down the conductive member 50*e* from the first position to the second position, causing the conductive member 50*e* to lie between the pair of wires 50*da* and 50*db* to connect the wires 50*da* and 50*db* to each other.

As illustrated in FIG. 6, when the coupling part 50*h* is further rotated by 180 degrees, the cam part 50*i* also rotates by 180 degrees, and the projecting portion of the cam part 50*i* returns to the same position as the position illustrated in FIG. 4. At this time, the conductive member 50*e* does not return to the original position but maintains the conducting state between the pair of wires 50*da* and 50*db*.

In this way, according to the exemplary embodiment, the cam part 50*i* is driven by using a mechanism for driving the coupling part 50*h*, without providing an additional mechanism to drive the cam part 50*i* for moving the conductive member 50*e* that connects the pair of wires 50*da* and 50*db*. Therefore, even though a configuration for establishing connection between the pair of wires 50*da* and 50*db* is provided, this does not add complexity to the printer 1.

Figure 7:
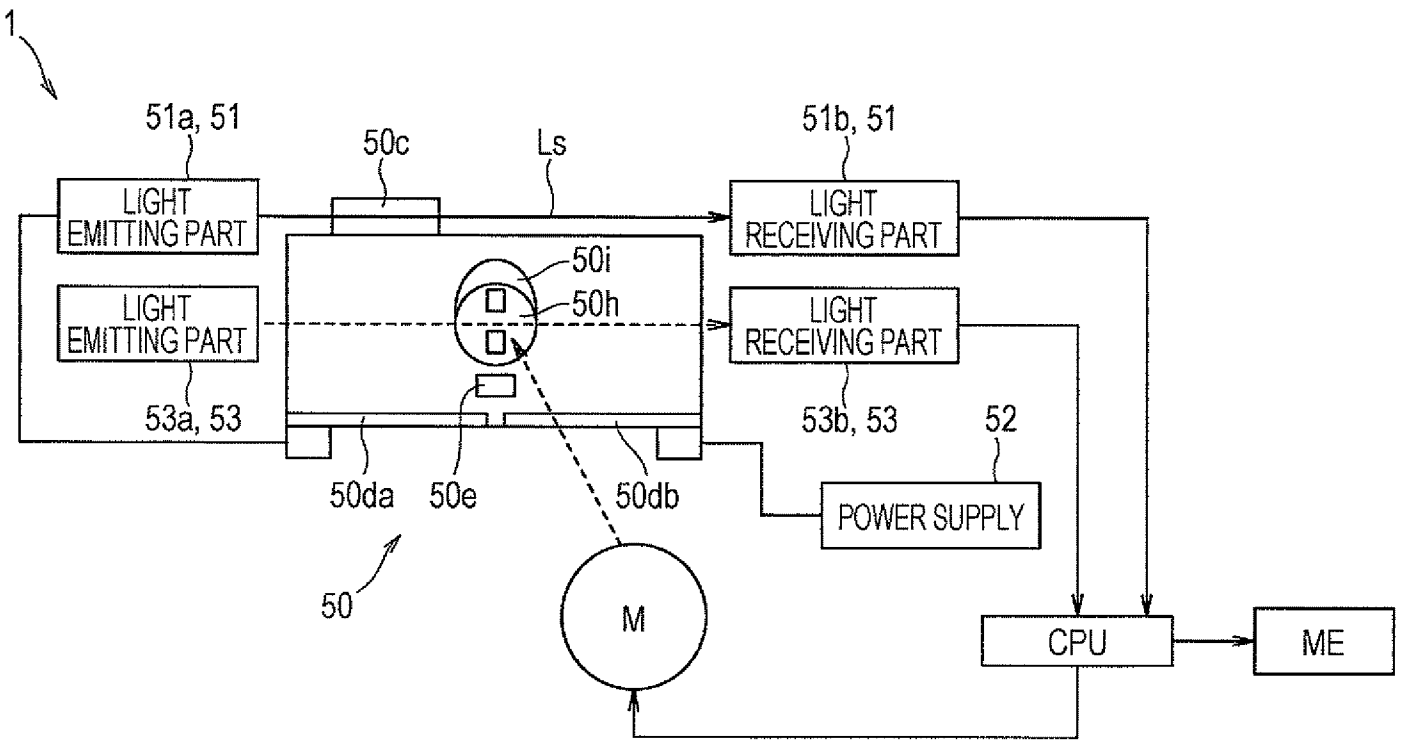
FIG. 7 is a circuit block diagram illustrating the state of electrical and optical connection when an unused developer recovery container is attached to an image forming apparatus.

FIG. 7 is a circuit block diagram illustrating the state of electrical and optical connection upon attaching the waste-toner recovery box 50 that is unused to the printer 1.

In addition to the aforementioned components, the printer 1 includes a light transmission sensor 53, a central processing unit (CPU), a memory ME, and the drive motor (an example of a drive section) M mentioned above.

The light transmission sensor 53 is a detecting section that detects whether or not the waste-toner recovery box 50 has been attached to the printer 1. The light transmission sensor 53 includes a light emitting part 53*a* and a light receiving part 53*b*. The light emitting part 53*a* and the light receiving part 53*b* are provided so as to sandwich the waste-toner recovery box 50. Of these two parts, the light receiving part 53*b* is electrically connected to the CPU.

The CPU (an example of determining section and history processing section) executes the processing described below, in addition to control of the overall image forming operation of the printer 1.

Specifically, the CPU determines whether or not the waste-toner recovery box 50 is attached to the printer 1 on the basis of a signal from the light receiving part 53*b* of the light transmission sensor 53.

The CPU is electrically connected to the light receiving part 51*b* of the light transmission sensor 51 mentioned above. On the basis of a signal transmitted from the light receiving section 51*b*, the CPU determines whether the waste-toner recovery box 50 is unused or used, and in a case where the waste-toner recovery box 50 is used, the CPU also determines whether the recovery status of waste toner is near full or vacant.

In a case where the waste-toner recovery box 50 is determined to be unused, the CPU clears the history on the near-full state of waste toner in the waste-toner recovery box 50 which is stored in the memory ME, and in a case where the waste-toner recovery box 50 is determined to be used, the CPU retains the history on the near-full state of waste toner in the waste-toner recovery box 50 which is stored in the memory ME.

Further, on the basis of a signal from the light receiving part 51*b* of the light transmission sensor 51, the CPU executes an attempt to drive the drive motor M to rotate the coupling part 50*h* (i.e. the cam part 50*i*) to thereby establish electrical connection between the pair of wires 50*da* and 50*db* by the conductive member 50*e*.

Figure 8:
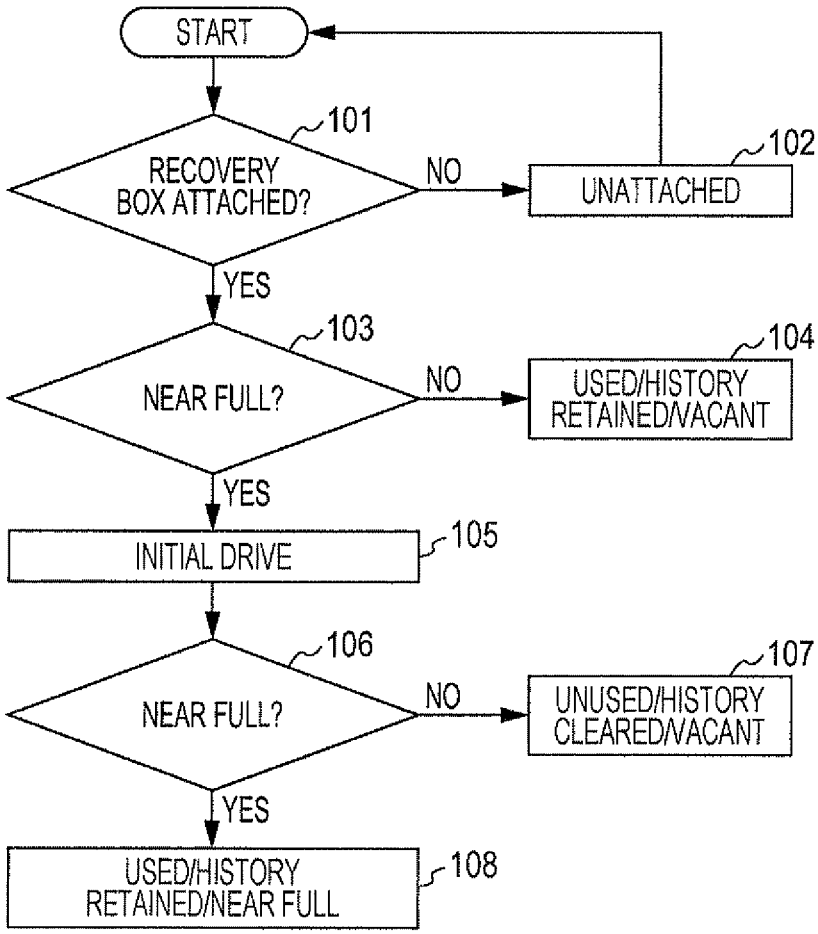
FIG. 8 is a process flow chart illustrating processing executed upon attaching a developer recovery container to the image forming apparatus illustrated in FIG. 1.

FIG. 8 is a process flow chart illustrating processing executed upon attaching the waste-toner recovery box 50 to the printer 1 according to the exemplary embodiment. FIG. 9 illustrates a summary of the results of the processing in FIG.

8. Hereinafter, processing executed to recover waste toner in the printer 1 according to the exemplary embodiment is described with reference to FIGS. 7 to 9.

First, on the basis of a detection signal from the light transmission sensor 53, it is judged whether or not the waste-toner recovery box 50 has been already attached to the printer 1 (step 101 in FIG. 8; Presence Detection in FIG. 9).

In a case where it is determined that the waste-toner recovery box 50 has not yet been attached (step 102 in FIG. 8; Determination: Unattached in FIG. 9), the processing returns to the start. If it is determined that the waste-toner recovery box 50 has been attached, it is judged on the basis of a detection signal from the light transmission sensor 51 whether the recovery status of the attached waste-toner recovery box 50 is near full (step 103 in FIG. 8; Recovery Status Judgment A in FIG. 9). Specifically, it is judged on the basis of information from the light transmission sensor 51 whether or not there is waste toner in the detection space of the detection window 50*c* of the waste-toner recovery box 50.

In a case where the light Ls is detected by the light receiving part 51*b* of the light transmission sensor 51 at this time, this indicates that the light Ls is emitted from the light emitting part 51*a*, and also that the light Ls is not blocked in the detection window 50*c* (there is no waste toner in the detection space of the detection window 50*c*). Hence, it is determined that the attached waste-toner recovery box 50 is used, and the recovery status thereof is determined to be vacant. Accordingly, the history on the near-full state of the waste-toner recovery box 50 stored in the memory ME is retained (step 104 in FIG. 8; Recovery Status Judgment A: Vacant (light received) and Determination on Used recovery box in FIG. 9).

The reason for the above determination results is described below. In a case where the attached waste-toner recovery box 50 is unused, power is not supplied to the light emitting part 51*a* of the light transmission sensor 51, and thus the light Ls is not emitted from the light emitting part 51*a*. Also, in a case where the attached waste-toner recovery box 50 is used and nearly full of waste toner, the light Ls emitted from the light emitting part 51*a* is blocked by the waste toner in the detection space inside the detection window 50*c*. Hence, it follows that the light Ls is not detected by the light receiving part 51*b* in either of these two cases.

In a case where the light Ls is not detected by the light receiving part 51*b* of the light transmission sensor 51, basically, it is judged that there is waste toner in the detection space of the detection window 50*c*, and the waste-toner recovery box 50 is judged to be nearly full of waste toner. In this regard, as mentioned above, according to the exemplary embodiment, in a case where the waste-toner recovery box 50 is unused, the light Ls is not emitted from the light receiving part 51*a*. Therefore, it is also conceivable that the light Ls is not detected by the light receiving part 51*b* for this reason.

Accordingly, in a case where the waste-toner recovery box 50 is judged to be near full at this point, the drive motor M is driven to rotate the coupling part 50*h* at least once (180 degrees). Thus, the cam part 50*i* is rotated at least once (180 degrees) to push the conductive member 50*e* down, thereby attempting to short-circuit the pair of wires 50*da* and 50*db* of the waste-toner recovery box 50 (step 105 in FIG. 8; Initial Drive; "Yes" in FIG. 9). As a result, in a case where the attached waste-toner recovery box 50 is unused, the conductive member 50*e* brings the pair of wires 50*da* and 50*db* into a conducting state, and power is supplied to the light emitting part 51*a* of the light transmission sensor 51. Thus, the light emitting part 51*a* emits light.

Thereafter, whether or not the recovery status of the attached waste-toner recovery box 50 is near full or not is judged on the basis of a detection signal from the light transmission sensor 51 (step 106 in FIG. 8; Recovery Status Judgment B on Used recovery box in FIG. 9). In other words, whether or not there is waste toner within the detection space of the detection window 50*c* of the waste-toner recovery box 50 is judged on the basis of information from the light transmission sensor 51.

In a case where the light Ls is detected by the light receiving part 51*b* after the cam part 50*i* is driven, it is determined that the light Ls is previously not detected by the light receiving part 51*b* in step 103 because power is not supplied to the light receiving part 51*b* at that point in time, and the waste-toner recovery box 50 is determined to be unused (Determination: Unused in FIG. 9). Also, because the light Ls is detected by the light receiving part 51*b*, it is judged that there is no waste toner in the detection space of the detection window 50*c*, and the waste-toner recovery box 50 is judged to be vacant. In this case, the history on the near-full state of the waste-toner recovery box 50 stored in the memory ME is cleared (step 107 in FIG. 8; History on Unused recovery box in FIG. 9).

In a case where the light Ls is not detected by the light receiving part 51*b* after the cam part 50*i* is driven, it is judged that there is waste toner in the detection space of the detection window 50*c*, the waste-toner recovery box 50 is used, and also that the recovery space is nearly full of waste toner (Recovery Status Judgment B and Determination on Near Full, Used recovery box in FIG. 9). In this case, the history on the near-full state of the waste-toner recovery box 50 stored in the memory ME retained (step 108 in FIG. 8; History on Near Full, Used recovery box in FIG. 9).

Next, an example of replacement of the waste-toner recovery box 50 of the printer 1 according to the exemplary embodiment is described.

(1) The printer 1 according to the exemplary embodiment is made to print under the conditions of, for example, 5% area coverage for YMCK each, full color, five sheets per job, and A4 sheets with their short sides aligned with the transport direction. It has been confirmed that after printing approximately 15000 sheets, a "near-full state" of the waste-toner recovery box 50 is detected, and a notification of the near-full state is issued.

The printer 1 used in the present case stores cumulative information on the number of sheets and number of pixels printed after a near-full state is detected, as history information. When these numbers exceed corresponding preset thresholds, the printer 1 determines that the waste-toner recovery box 50 is full, and displays an indication of this state. In this case, for example, the printer 1 determines the waste-toner recovery box 50 to be full when 4000 sheets or the number of pixels equivalent to 4000 sheets have been printed after detecting a near-full state. The printer 1 then displays a message suggesting replacement of the waste-toner recovery box 50, and disables print operation. While the exemplary embodiment uses the number of sheets and number of pixels printed as history information, the history information is not limited to this example. Any information related to the toner discharged, such as the driving time of a motor used for dispensing toner of each color, may be used as the history information.

In this state, for example, after 2000 sheets are further printed, the waste-toner recovery box 50 is detached, and then attached to the printer 1 again while keeping the state of waste toner in the detection space of the detection window 50*c* unchanged. Since the waste-toner recovery box 50 has already been used, before executing the initial drive of the leveling member 50*g* (cam part 50*i*), a near-full state is detected, and the near-full state is detected also after the initial drive. Accordingly, the history information (2000 sheets printed after detection of the near-full state) is retained without being cleared, and printing of approximately 2000 sheets is continued in that state before it is determined that the waste toner in the waste-toner recovery box 50 is full and the printer 1 stops operating.

(2) Under the same conditions as (1) above, after the near-full state is detected, for example, 2000 sheets are printed before replacing the waste-toner recovery box 50 with a new, unused waste-toner recovery box 50. The near-full state is detected before executing the initial drive of the leveling member 50*g* (cam part 50*i*), but after the initial drive of the leveling member 50*g* (cam part 50*i*), the state becomes the vacant state. This is because the power supply to the light emitting part 51*a* of the light transmission sensor 51 has changed from a non-conducting state into a conducting state owing to the initial drive. At this time, the printer 1 determines that an unused waste-toner recover box 50 has been attached, and the history information is cleared. Printing is continued in this state, and the near-full state is detected again after printing approximately 15000 sheets.

(3) Under the same conditions as (1) above, after the near-full state is detected, for example, 2000 sheets are printed before detaching the waste-toner recovery box 50. At this time, after applying vibration to the detached waste-toner recover box 50 so that there is no waste toner in the detection space of the detection window 50*c*, the waste-toner recovery box 50 is attached to the printer 1 again. In this case, the waste-toner recovery box 50 is determined to be vacant before the initial drive of the leveling member 50*g* (cam part 50*i*) is executed. Thus, it is determined that the waste-toner recovery box 50 is used, and the history information is not cleared. When printing is further continued in this state, approximately 2000 sheets are continuously printed before it is determined that the waste-toner recovery box 50 is full and the printer 1 stops operating.

The same checking as (3) above is conducted while changing the settings so as to determine a full state on the basis of near-full state detection alone, without making a judgment as to whether the waste-toner recovery box 50 is unused or used on the basis of changes in state before and after the initial drive of the leveling member 50*g* (cam part 50*i*). After detecting the near-full state, 2000 sheets are printed and then the waste-toner recovery box 50 is detached. The waste-toner recovery box 50 is attached to the printer 1 again after making sure that there is no waste toner in the detection space of the detection window 50*c*.

Then, the attached waste-tone recovery box 50 is judged to be vacant, and the history information is cleared. When printing is continued in this state, the near-full state is detected again after printing approximately 1000 sheets. This is because waste toner once removed from the detection space of the detection window 50*c* with application of vibration is transported into the detection space of the detection window 50*c* again. After further printing 2000 sheets continuously, noise due to a defect in the drive motor M or the like has occurred owing to an increase in the amount of waste toner. This is because 5000 sheets have been actually printed even through the history information indicates that 2000 sheets have been printed after detecting the near-full state.

In this regard, the following technique is conceivable. Specifically, in a case where the waste-toner recovery container is replaced with another one when the amount of waste toner calculated upon detecting the near-full state by the waste-toner detecting section is equal to or more than a predetermined value, it is determined that the recovery container has been replaced with a new one. However, in a case where the waste-toner recovery container is detached when the calculated amount of waste toner exceeds a predetermined value, and the detecting section then detects that the waste toner is not near full, the waste-toner recovery container is erroneously detected as being unused even when the waste-toner recovery container is attached again. This leads to defects such as jamming or spilling out of waste toner, or the resulting noise of the equipment.

According to the exemplary embodiment, as mentioned above, whether the waste-toner recovery box 50 attached to the printer 1 is used or unused is determined with reliability, and history on the waste-toner recovery status is stored properly, thereby preventing defects such as jamming or spilling out of waste toner or the resulting noise of the equipment.

A technique is conceivable in which a floating member rotates in accordance with the amount of waste toner recovered, a flag member detects a full state of waste toner, and the position of the flag member is fixed upon detecting the full state, thereby preventing erroneous detection of the recovery status of waste toner due to detachment of the waste-toner recovery container. However, a complex mechanism is necessary to fix the floating member and the flag member into position, and it is also necessary that the floating member operates reliably in accordance with the amount of toner recovered, making it difficult to ensure stability of operation.

According to the exemplary embodiment, the cam part 50*i* for establishing connection between the pair of wires 50*da* and 50*db* of an unused waste-toner recovery box 50 is driven by the mechanism used to drive the leveling member 50*g*, without providing an additional drive mechanism. Thus, there is no increase in the cost of the printer 1. Also, operation does not become unstable owing to the simple configuration in which the conductive member 50*e* simply moves with rotation of the cam part 50*i*. Therefore, whether the waste-toner recovery box 50 attached to the printer 1 is used or unused is reliably determined with a simplified and inexpensive configuration.

While the exemplary embodiment of the invention contemplated by the inventors has been described above in detail, the foregoing description of the exemplary embodiment disclosed herein has been provided for the purposes of illustration and description, and is not intended to be exhaustive or to limit the invention to the precise forms disclosed. The technical scope of the invention should not be construed restrictively on the basis of the foregoing description of the exemplary embodiment but should be defined by the appended claims, and is intended to cover all equivalents of the claims and modifications that fall within the scope of the claims.

For example, the foregoing description of the exemplary embodiment is directed to the case of replacing the waste-toner recovery box in the image forming apparatus employing an intermediate transfer system in which the toner image once transferred onto the intermediate transferred belt is transferred to the recording sheet. The exemplary embodiment is not limited to this. The exemplary embodiment may be also applied to replacement of the waste-toner recovery box in an image forming apparatus employing a direct transfer system in which the toner image on the photoconductor drum is directly transferred to the recording sheet.

In the foregoing description, the developer recovery container according to the exemplary embodiment of the invention is applied to an image forming apparatus that records images in color. The developer recovery container may be also applied to an image forming apparatus that records monochrome images.

The foregoing description is directed to the case of applying the exemplary embodiment to a printer. The exemplary embodiment may be also applied to a copier, a facsimile, or multi-function equipment combining these functions.

What is claimed is:

1. An image forming apparatus comprising:

a body;

a developer recovery container that is detachably provided to the body, and contains a developer that has been recovered;

a detecting section that is provided to the body, and detects a recovery status of the developer contained within the developer recovery container;

a power supply that supplies electric power to the detecting section;

a detection object part that is provided to the developer recovery container, and is a part to be detected by the detecting section, the detection object part indicating the recovery status of the developer in the developer recovery container on a basis of presence or absence of the developer;

a pair of wires that are provided to the developer recovery container, the wires being electrically isolated from each other and one of the wires being electrically connected to the detecting section and the other of the wires being electrically connected to the power supply in a case where the developer recovery container has not been used;

a conducting section that is provided to the developer recovery container, and is located in a first position in a case where the developer recovery container has not been used and is located in a second position in a case where the developer recovery container has been used, the first position being a position that brings the pair of wires into a non-conducting state, the second position being a position that brings the pair of wires into a conducting state;

a drive section that electrically connects the pair of wires, and drives the conducting section to the second position to maintain the conducting state of the pair of wires; and a determining section that determines the developer recovery container to have been used in a case where the developer is determined to be not present in the detection object part on a basis of information from the detecting section, and in a case where the developer is determined to be present in the detection object part, checks the information from the detecting section again after driving the drive section, and determines the developer recovery container to have not been used in a case where the developer is determined to be not present in the detection object part and determines the developer recovery container to have been used in a case where the developer is determined to be present in the detection object part.

2. The image forming apparatus according to claim 1, wherein:

the developer recovery container includes a leveling section that levels the developer in the developer recovery container; and the drive section drives the leveling section.

3. The image forming apparatus according to claim 2, further comprising a history processing section that clears a history on the recovery status of the developer in the developer recovery container in a case where the developer recovery container is determined to have not been used, and retains the history on the recovery status of the developer in the developer recovery container held in the image forming apparatus in a case where the developer recovery container is determined to have been used.

4. The image forming apparatus according to claim 1, further comprising a history processing section that clears a history on the recovery status of the developer in the developer recovery container in a case where the developer recovery container is determined to have not been used, and retains the history on the recovery status of the developer in the developer recovery container held in the image forming apparatus in a case where the developer recovery container is determined to have been used.

5. An image forming system comprising:

a body;

a developer recovery container that is detachably provided to the body, and contains a developer that has been recovered;

a detecting section that is provided to the body, and detects a recovery status of the developer contained within the developer recovery container;

a power supply that supplies electric power to the detecting section;

a detection object part that is provided to the developer recovery container, and is a part to be detected by the detecting section, the detection object part indicating the recovery status of the developer in the developer recovery container on a basis of presence or absence of the developer;

a pair of wires that are provided to the developer recovery container, the wires being electrically isolated from each other and one of the wires being electrically connected to the detecting section and the other of the wires being electrically connected to the power supply in a case where the developer recovery container has not been used;

a conducting section that is provided to the developer recovery container, and is located in a first position in a case where the developer recovery container has not been used and is located in a second position in a case where the developer recovery container has been used, the first position being a position that brings the pair of wires into a non-conducting state, the second position being a position that brings the pair of wires into a conducting state;

a drive section that electrically connects the pair of wires, and drives the conducting section to the second position to maintain the conducting state of the pair of wires; and a determining section that determines the developer recovery container to have been used in a case where the developer is determined to be not present in the detection object part on a basis of information from the detecting section, and in a case where the developer is determined to be present in the detection object part, checks the information from the detecting section again after driving the drive section, and determines the developer recovery container to have not been used in a case where the developer is determined to be not present in the detection object part and determines the developer recovery container to have been used in a case where the developer is determined to be present in the detection object part.

6. A computer readable medium storing a program causing a computer to execute a process, the process comprising:

performing a first judgment that judges whether or not a developer recovery container has been attached to a body of an image forming apparatus having a detecting section that detects a recovery status of a developer in the developer recovery container on a basis of presence or absence of the developer in a detection object part of the developer recovery container, the developer recovery container including a pair of wires that bring the detecting section and a power supply that supplies electric power to the detecting section into a non-conducting state in a case where the developer recovery container has not been used, and bring the detecting section and the power supply into a conducting state in a case where the developer recovery container has been used;

performing a second judgment that judges whether or not the developer is present in the detection object part of the developer recovery container on a basis of information from the detecting section, in a case where the developer recovery container is judged to have been attached as a result of the first judgment;

performing a first determination that determines the developer recovery container to have been used, in a case where the developer is judged to be not present in the detection object part as a result of the second judgment;

attempting a short-circuit of the pair of wires of the developer recovery container, in a case where the developer is judged to be present in the detection object part as a result of the second judgment;

performing a third judgment that judges whether or not the developer is present in the detection object part of the developer recovery container on the basis of the information from the detecting section, after the attempting of the short-circuit;

performing a second determination that determines the developer recovery container to have not been used, in a case where the developer is judged to be not present in the detection object part as a result of the third judgment; and performing a third determination that determines the developer recovery container to have been used, in a case where the developer is judged to be present in the detection object part as a result of the third judgment.

* * * * *